US007761018B2

(12) United States Patent
Etoh

(10) Patent No.: US 7,761,018 B2
(45) Date of Patent: Jul. 20, 2010

(54) IMAGE FORMING APPARATUS

(75) Inventor: Takuya Etoh, Osaka (JP)

(73) Assignee: Ricoh Company, Limited, Tokyo (JP)

( * ) Notice: Subject to any disclaimer, the term of this patent is extended or adjusted under 35 U.S.C. 154(b) by 165 days.

(21) Appl. No.: 12/219,607

(22) Filed: Jul. 24, 2008

(65) Prior Publication Data

US 2009/0035032 A1 Feb. 5, 2009

(30) Foreign Application Priority Data

Jul. 31, 2007 (JP) ..... 2007-198928
Feb. 29, 2008 (JP) ..... 2008-049962

(51) Int. Cl.
*G03G 15/00* (2006.01)

(52) U.S. Cl. ..... 399/44

(58) Field of Classification Search ..... 399/44, 399/94, 322, 364, 390, 401
See application file for complete search history.

(56) References Cited

U.S. PATENT DOCUMENTS 4,125,325 A * 11/1978 Batchelor et al. ..... 355/26
4,130,354 A * 12/1978 Steiner ..... 355/26
5,029,314 A * 7/1991 Katsumi et al. ..... 399/44
5,907,740 A * 5/1999 Nozawa ..... 399/43
7,621,632 B2 * 11/2009 Imoto et al. ..... 347/104
2001/0000462 A1 * 4/2001 Blackman et al. ..... 399/13
2003/0156871 A1 * 8/2003 Carlson et al. ..... 399/390
2004/0037601 A1 * 2/2004 Uchida et al. ..... 399/396
2006/0110172 A1 * 5/2006 Iijima et al. ..... 399/44
2007/0014610 A1 * 1/2007 Carter et al. ..... 399/401
2007/0065201 A1 3/2007 Fujiwara et al.
2007/0172255 A1 7/2007 Nanno et al.
2008/0019715 A1 * 1/2008 Furukawa et al. ..... 399/44

FOREIGN PATENT DOCUMENTS

JP 08-234649 9/1996
JP 2005-274835 10/2005
JP 2006-206236 8/2006

* cited by examiner

*Primary Examiner*—David P Porta
*Assistant Examiner*—Kiho Kim
(74) *Attorney, Agent, or Firm*—Harness, Dickey & Pierce, P.L.C.

(57) ABSTRACT

An image forming apparatus transfers a toner image on a recording medium in a transfer unit and fixes the toner image on the recording medium in a fixing unit. The image forming apparatus performs duplex image formation in a first mode and a second mode. The first mode is a mode in which a toner image is transferred and fixed on a second side of a recording medium after a toner image is transferred and fixed on a first side thereof. The second mode is a mode in which, after a toner image is transferred and fixed on a first side of a recording medium fed at first, a second side of the recording medium is subjected to fixing without transferring thereon a toner image.

18 Claims, 4 Drawing Sheets

IMAGE FORMING APPARATUS

CROSS-REFERENCE TO RELATED APPLICATIONS

The present application claims priority to and incorporates by reference the entire contents of Japanese priority document 2007-198928 filed in Japan on Jul. 31, 2007 and 2008-049962 filed in Japan on Feb. 29, 2008.

BACKGROUND OF THE INVENTION

1. Field of the Invention

The present invention relates to a technology for removing dew gathered in an image forming apparatus due to condensation.

2. Description of the Related Art

An image forming apparatus includes heat generating constituent elements such as various motors and a fixing unit. The heat generated by those elements leads to rise in the internal temperature of the image forming apparatus. The temperature difference between the internal temperature and the outside temperature leads to dew condensation in the image forming apparatus. Particularly, when the fixing unit applies heat and pressure to a recording medium (hereinafter, "sheet") for fixing an image thereon in a low-temperature high-humidity environment, the moisture in the sheet vaporizes and builds up dew condensation in a conveying path near the fixing unit. If a sheet picks up the dew while being conveyed, the wet sheet may get jammed or skewed. Moreover, black spots appear on the wet sheet when an image is transferred thereon and the image quality degrades.

Japanese Patent Application Laid-open No. H8-234649 discloses an image forming apparatus with a dew removal mode. When the dew removal mode is implemented, a photosensitive drum is rotated without forming thereon an electrostatic latent image. A sheet is then conveyed over the photosensitive drum to remove dew condensation from the surface of the photosensitive drum. The wet sheet is then discharged to a discharge unit without forming an image thereon.

Moreover, Japanese Patent Application Laid-open No. 2006-206236 discloses an image forming apparatus that includes a dew condensation sensor for sensing dew condensation in a conveying path of the sheets and a control unit for controlling the conveyance of the sheets based on the result of the dew condensation sensor. More particularly, if the dew condensation sensor detects dew condensation during a warm-up period after switching ON the image forming apparatus, the control unit instructs a feeding unit to convey at least one sheet stacked therein via the conveying path such that the conveyed sheet removes the dew. The wet sheet is then discharged to a discharge unit without forming an image thereon.

Furthermore, Japanese Patent Application Laid-open No. 2005-274835 discloses an image forming apparatus that includes a conveying mechanism in which a discharging path and a re-conveying path for duplex image formation bifurcate at a position downstream of a fixing unit. During single image formation, a conveying roller (inverter roller) in the re-conveying path is subjected to idle rotation such that an air layer is formed around the conveying roller. The air layer prevents the moisture coming out of the fixing unit from settling in the re-conveying path, which remains idle during single image formation. Such a mechanism prevents dew condensation in the re-conveying path.

Meanwhile, in recent years, a sheet in a feeding unit is conveyed vertically upward and opposite to the direction of gravitational force to a discharge unit. Such a configuration is less conducive to dew condensation than an image forming apparatus having horizontal conveying mechanism. Howbeit, it is not possible to completely prevent dew condensation. Therefore, it is necessary to continue research on optimizing air flow design, sheet guiding design, and manufacturing material for an image forming apparatus.

However, the conventional technology of conveying blank sheets in a conveying path to remove the dew and then discharging the wet blank sheets without forming an image thereon leads to wastage of sheets.

SUMMARY OF THE INVENTION

It is an object of the present invention to at least partially solve the problems in the conventional technology.

According to an aspect of the present invention, there is provided an image forming apparatus that transfers a toner image on a recording medium in a transfer unit and fixes the toner image on the recording medium in a fixing unit, and that is capable of performing duplex image formation. The image forming apparatus includes a control unit that performs a first control in which a toner image is transferred and fixed on a second side of a recording medium after a toner image is transferred and fixed on a first side thereof, and a second control in which, after a toner image is transferred and fixed on a first side of a recording medium fed at first, a second side of the recording medium is subjected to fixing without transferring thereon a toner image.

According to another aspect of the present invention, there is provided an image forming apparatus that transfers a toner image on a recording medium in a transfer unit and fixes the toner image on the recording medium in a fixing unit, and that is capable of performing duplex image formation by an Interleaf control of more than two recording media. The image forming apparatus includes a control unit that performs a first control in which a toner image is transferred and fixed on a second side of a recording medium after a toner image is transferred and fixed on a first side thereof, and a second control in which, after a toner image is transferred and fixed on a first side of a recording medium fed at first, a second side of the recording medium is subjected to fixing without transferring thereon a toner image, and usual interleaf control is performed thereafter.

According to still another aspect of the present invention, there is provided an image forming apparatus that transfers a toner image on a recording medium in a transfer unit and fixes the toner image on the recording medium in a fixing unit, and that is capable of performing duplex image formation by a BBAA control for two recording media. The image forming apparatus including a control unit that performs a first control in which a toner image is transferred and fixed on a second side of a recording medium after a toner image is transferred and fixed on a first side thereof, and a second control in which a recording medium fed at first is subjected to fixing without transferring thereon a toner image, and usual BBAA control for two recording media is performed thereafter.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings. The present invention is not limited to these exemplary embodiments.

Figure 1:
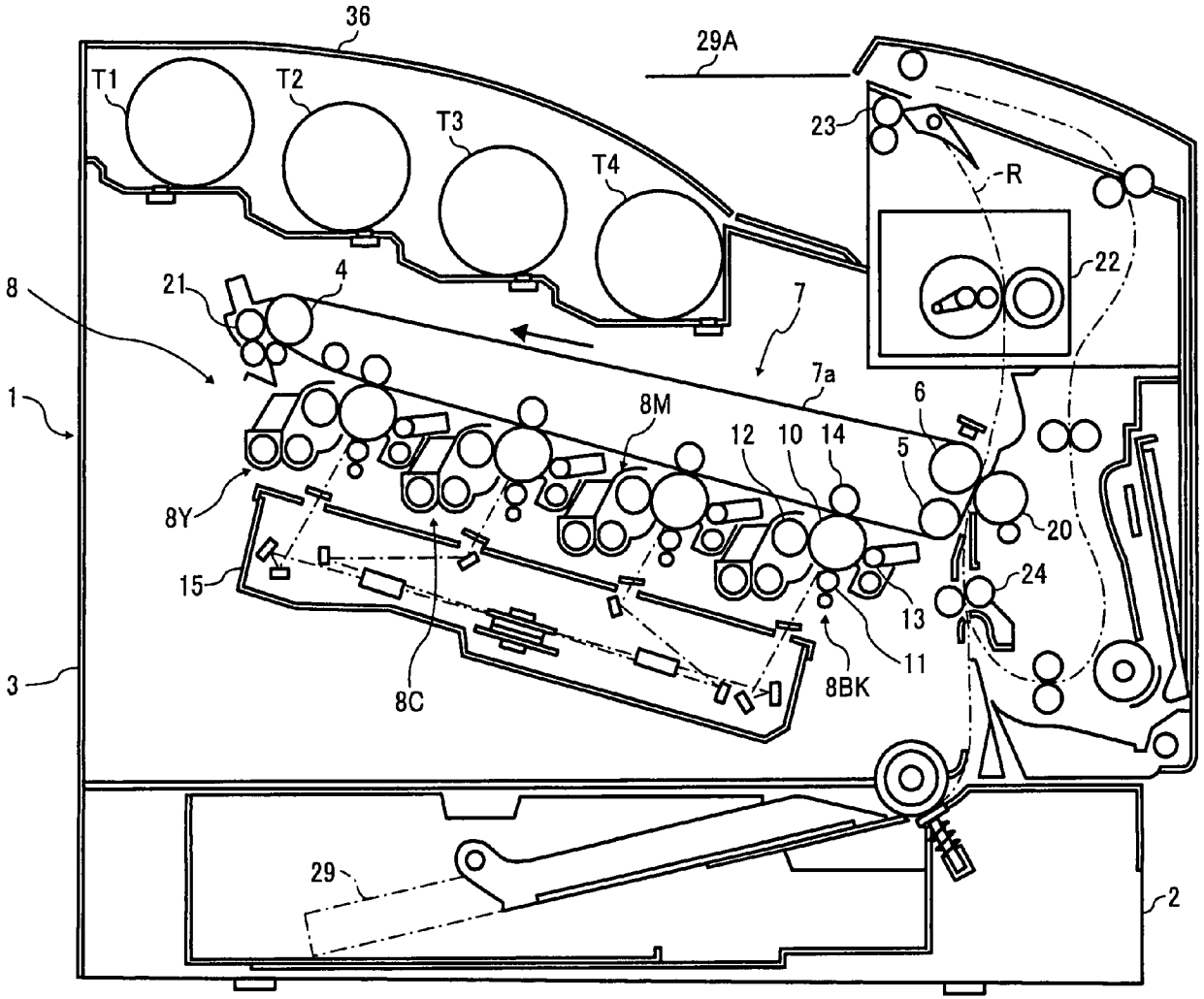
FIG. 1 is a schematic diagram of an image forming apparatus according to an embodiment of the present invention.

FIG. 1 is a schematic diagram of an image forming apparatus 1 (e.g., a printer) according to an embodiment of the present invention. A sheet feeding cassette 2 is arranged in the bottom portion of the image forming apparatus 1. The sheet feeding cassette 2 feeds a single sheet 29 at a time from a sheet stack to an image forming mechanism 3. The image forming mechanism 3 is arranged above the sheet feeding cassette 2, and includes an image creating mechanism 8, an intermediate transfer unit 7, an optical writing unit 15, and a fixing unit 22. The image creating mechanism 8 includes four image creating units 8Y, 8C, 8M, and 8BK. Each of the image creating units 8Y, 8C, 8M, and 8BK includes a photosensitive drum 10 as an image carrying member, and a charging unit 11, a developing unit 12, and a cleaning unit 13 that are arranged around the photosensitive drum 10. The intermediate transfer unit 7 includes an intermediate transfer belt 7*a*, which is a flexible endless belt, stretched around rollers 4, 5, and 6. The optical writing unit 15 performs optical writing on each photosensitive drum 10. The fixing unit 22 fixes a toner image on the sheet 29. The image creating mechanism 8 and the intermediate transfer unit 7 are detachably arranged in the image forming apparatus 1. The sheet 29 is conveyed to the fixing unit 22 from the sheet feeding cassette 2 via a conveying path R. The roller 6 is arranged along the conveying path R. The intermediate transfer unit 7, the image creating mechanism 8, the optical writing unit 15, and the fixing unit 22 are arranged substantially in the center of the image forming apparatus 1.

A secondary transfer roller 20 is arranged along the conveying path R and faces the roller 6 to form a secondary transfer nip 54 therebetween. An image is transferred on the sheet 29 while being nipped through the secondary transfer nip 54. A belt cleaning unit 21 is arranged near the roller 4.

The image creating mechanism 8 is arranged beneath the intermediate transfer unit 7, i.e., below the bottom side of the intermediate transfer belt 7*a* between the rollers 4 and 5. More particularly, the photosensitive drum 10 in each of the image creating units 8Y, 8C, 8M, and 8BK is arranged to abut against the bottom side of the intermediate transfer belt 7*a* from below. Four transfer rollers 14 are arranged on the inside of the bottom side of the intermediate transfer belt 7*a*. Each transfer roller 14 forms a pair with one of the photosensitive drums 10 such that the intermediate transfer belt 7*a* is sandwiched therebetween.

Each of the image creating units 8Y, 8C, 8M, and 8BK has an identical structure. However, for simplification, reference numerals are given for the constituent elements in only the image creating unit 8BK. The developing unit 12 in each of the image creating units 8Y, 8C, 8M, and 8BK contains a toner, which is a developing powder, of yellow, cyan, magenta, and black, respectively. Four toner bottles T1, T2, T3, and T4 are arranged in the top portion of the image forming apparatus 1 for supplying a corresponding toner to each developing unit 12 based on the amount of toner remaining in the developing units 12.

The optical writing unit 15 is arranged beneath the image creating mechanism 8 and radiates an optical modulated laser light L on the surface of each photosensitive drum 10 such that an electrostatic latent image in the corresponding toner color is formed thereon.

The toner bottles T1, T2, T3, and T4, the intermediate transfer unit 7, the image creating mechanism 8, and the optical writing unit 15 are arranged in a uniform slanting manner with respect to the image forming apparatus 1. Such a slanting arrangement is space saving as compared to a horizontal arrangement.

When a user instructs the image forming apparatus 1 to start image formation, a driving unit (not shown) rotates the photosensitive drums 10 in the clockwise direction such that the surface of each photosensitive drum 10 gets uniformly charged to a predetermined polarity by the corresponding charging unit 11. The optical writing unit 15 then radiates the laser light L to the charged surface of each photosensitive drum 10 and forms thereon an electrostatic latent image. Irradiating each photosensitive drum 10 with the laser light L means exposing it to single-color image information (in yellow, cyan, magenta, or black) corresponding to desired full-color image information. Consequently, each developing unit 12 transfers a toner on the corresponding photosensitive drum 10 develops the electrostatic latent image into a single-color toner image in the color of the transferred toner.

One of the rollers 4, 5, and 6 is rotated in the anticlockwise direction such that the intermediate transfer belt 7*a* starts rotating in the same direction. Consequently, the remaining two rollers also rotate in the same direction. After the intermediate transfer belt 7*a* starts rotating, a yellow toner image formed on the photosensitive drum 10 in the image creating unit 8Y is transferred on the intermediate transfer belt 7*a* by the corresponding transfer roller 14. Then, a cyan toner image, a magenta toner image, and a black toner image formed in the image creating units 8C, 8M, and 8BK, respectively, are sequentially superimposed on the yellow toner image by the corresponding transfer rollers 14. As a result, a full-color toner image is formed on the intermediate transfer belt 7*a*.

After the single-color toner images are transferred on the intermediate transfer belt 7*a*, each cleaning unit 13 cleans the residual toner on the corresponding photosensitive drum 10. Consequently, the surface of each photosensitive drum 10 is neutralized by a corresponding neutralization unit (not shown) such that a new single-color toner image can be formed thereon.

Meanwhile, the sheet 29 fed from the sheet feeding cassette 2 is conveyed via the conveying path R. A pair of registration rollers 24, which is arranged between the sheet feeding cassette 2 and the secondary transfer roller 20 along the conveying path R, conveys the sheet 29 to the secondary transfer nip 54 at the same timing when the full-color toner image on the intermediate transfer belt 7*a* reaches the secondary transfer nip 54. The secondary transfer roller 20 gets charged to a polarity opposite to that of the full-color toner image. As a result, when the sheet 29 is nipped through the secondary transfer nip 54, the full-color toner image gets transferred on the sheet 29 from the intermediate transfer belt 7*a*. The sheet 29 is then conveyed to the fixing unit 22, which applies heat and pressure to the sheet 29 such that the full-color toner image is fixed on the sheet 29 to obtain a full-color image. The sheet 29 with a full-color image formed thereon (indicated by '29A' in FIG. 1) is conveyed to a discharging-cum-switchback roller 23 and discharged to a catch tray 36 on the top portion of the image forming apparatus 1. Meanwhile, after the full-color toner image is transferred on the sheet 29, the belt cleaning unit 21 cleans the residual toner from the intermediate transfer belt 7*a*.

As described above, the image creating mechanism 8 includes the image creating units 8Y, 8C, 8M, and 8BK, each of which is arranged facing the intermediate transfer belt 7*a* from below and includes the corresponding developing unit 12. Such a configuration enables sequential transfer of four single-color toner images on the intermediate transfer belt 7*a* to obtain a full-color toner image. Moreover, such a configuration saves considerable time as compared to a single image creating unit in which four single-color toner images are developed on a single photosensitive drum by using four developing units and each single-color toner image is superimposed on an intermediate transfer belt. Furthermore, because it is not necessary to pull the catch tray 36 out of the image reading apparatus 1 to collect the discharged sheet 29, it is possible to downsize the image forming apparatus 1.

The above description is given for full-color image formation on the sheet 29. However, it is also possible to form a monochromatic image, a dichromatic image, or a trichromatic image by using a combination of the image creating units 8Y, 8C, 8M, and 8BK. Meanwhile, a black-and-white image can be formed on the sheet 29 by forming an electrostatic latent image only on the photosensitive drum 10 in the image creating unit 8BK, developing the electrostatic latent image into a black toner image, and transferring the black toner image on the sheet 29. The fixing unit 22 then fixes the black toner image on the sheet 29 to obtain a black-and-white image.

Figure 2:
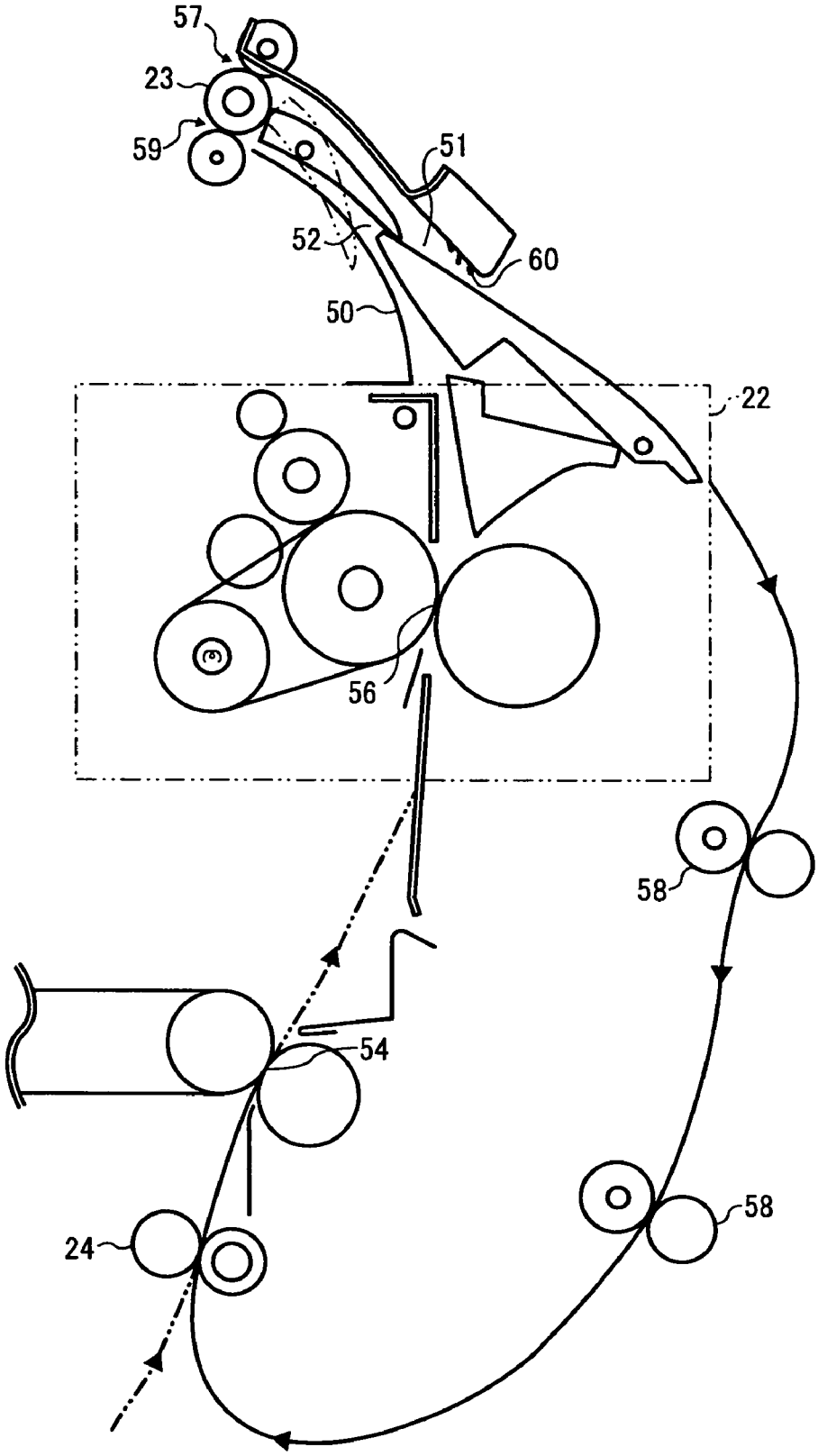
FIG. 2 is an enlarged view of a fixing unit, and a sheet reversing and re-conveying mechanism in the image forming apparatus.

FIG. 2 is an enlarged view of the fixing unit 22, and a sheet reversing and re-conveying mechanism. A sheet discharging path 50 shown in FIG. 2 is used for discharging a sheet to the catch tray 36 irrespective of single-side image formation or duplex image formation. A sheet re-conveying path 51 is used for re-conveying a sheet to the secondary transfer roller 20 for duplex image formation after single-side image formation is performed. The sheet discharging path 50 and the sheet re-conveying path 51 bifurcate at a bifurcation point 52, which lies downstream of the fixing unit 22 at an upper position. As described above, the fixing unit 22 applies heat and pressure to fix a toner image on a sheet. However, if the internal temperature of the image forming apparatus 1 is low when the fixing unit 22 is operating, then the moisture in the sheet or the toners in the toner image vaporizes and builds up dew condensation in the sheet discharging path 50 and the sheet re-conveying path 51. However, the amount of dew condensation is less in the sheet discharging path 50 than in the sheet re-conveying path 51. That is because, irrespective of single-side image formation and duplex image formation, each sheet is subjected to heat in the fixing unit 22 before being discharged to the catch tray 36 via the sheet-discharging path 50. In other words, a sheet is warm when conveyed through the sheet discharging path 50 thereby resulting in temperature rise in the sheet discharging path 50. Moreover, because each sheet is discharged to the catch tray 36, which is on the outside of the image forming apparatus 1, the remaining moisture in the sheet does not settle in the sheet discharging path 50. Thus, less amount of dew gathers in the sheet discharging path 50. On the other hand, if a plurality of sheets is continuously subjected to single-side image formation and discharged via the sheet discharging path 50, then the sheet re-conveying path 51 remains idle for that period. As a result, the sheet re-conveying path 51 becomes more conducive to dew condensation near the bifurcation point 52. Particularly, if, after performing continuous single-side image formation, a sheet is re-conveyed via the sheet re-conveying path 51 for duplex image formation, the sheet picks up dew 60 shown in FIG. 2 on the edge of a second side thereof, on which a toner image is transferred at a second time. When such a wet sheet reaches the secondary transfer nip 54, then the toner image on the intermediate transfer belt 7*a* may not be properly transferred on the second side. That may result in degradation of the image quality.

Given below is the description of conventional duplex image formation performed in the image forming apparatus 1. First, the sheet 29 fed from the sheet feeding cassette 2 reaches the pair of registration rollers 24, which performs skew correction and conveys the sheet 29 to the secondary transfer nip 54. While being nipped through the secondary transfer nip 54, a toner image is transferred on a first side of the sheet 29. The sheet 29 then reaches the fixing unit 22. The toner image is fixed on the first side while being nipped through a fixing nip 56 in the fixing unit 22. In the case of duplex image formation, the sheet 29 is conveyed to a switchback path 57 via the sheet discharging path 50. The discharging-cum-switchback roller 23 then rotates in a direction opposite to the direction at the time of discharging a sheet such that the sheet 29 is re-conveyed via the sheet re-conveying path 51. The re-conveyed sheet 29 reaches a pair of re-conveying rollers 58 that convey it to the pair of registration rollers 24 for a second time. Consequently, when the sheet 29 reaches the secondary transfer nip 54, a toner image is transferred on a second side thereof. The toner image is then fixed on the second side while being nipped through the fixing nip 56 in the fixing unit 22. Finally, the sheet 29 is conveyed via the sheet discharging path 50 and discharged to the catch tray 36 through a discharge opening 59. When such duplex image formation is performed for a plurality of sheets in a low-temperature environment, then a sheet may pick up the dew 60 on the edge of the second side thereof. That may result in poor image transfer from the intermediate transfer belt 7*a*.

Given below is the description of a duplex image formation mechanism to avoid the abovementioned problem. It is assumed that after transferring and fixing a toner image on a first side of the sheet 29 fed at first from the sheet feeding cassette 2, the sheet 29 is re-conveyed to the sheet re-conveying path 51 in which it picks up the dew 60 on the second side thereof. In that case, the wet sheet 29 is re-conveyed to the fixing nip 56 without transferring a toner image on a second side thereof at the secondary transfer nip 54. After the fixing unit 22 applies heat to the blank second side, the dry sheet 29 is conveyed to the switchback path 57, from where it is re-conveyed for a second time via the sheet re-conveying path 51. When the sheet 29 reaches the secondary transfer nip 54 for a third time, the first side thereof faces the intermediate transfer belt 7*a*. However, because a toner image is already fixed on the first time, the sheet 29 is conveyed to the fixing unit 22 without transferring a toner image thereon. Consequently, the sheet 29 is re-conveyed for a third time via the sheet re-conveying path 51. This time, the second side thereof faces the intermediate transfer belt 7*a* at the secondary transfer nip 54. Thus, a toner image is transferred on the second side and fixed thereon in the fixing unit 22. The sheet 29 is then discharged to the catch tray 36 via the sheet discharging path 50. By implementing such a duplex image formation mechanism, it is possible to evaporate the dew 60 picked up by the sheet 20 on the second side thereof. Moreover, the duplex image formation mechanism can be implemented without increasing the manufacturing cost, wasting the sheets, or affecting the user-friendliness of the image forming apparatus 1.

Figures 3A, 3B, 3C, 3D:
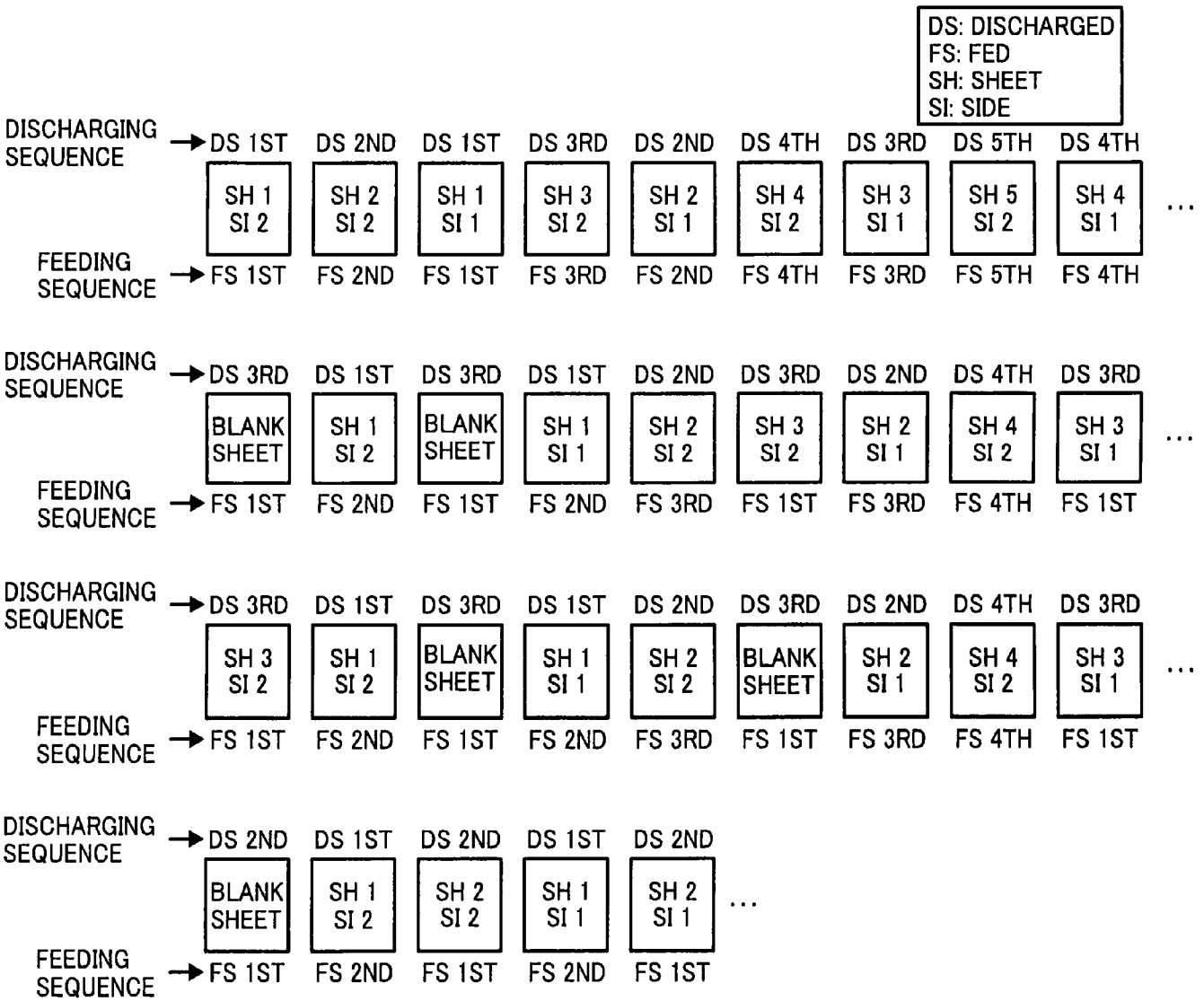
FIG. 3A is a diagram for explaining duplex image formation by conventional non-stack interleaf control.
FIGS. 3B and 3C are diagrams for explaining duplex image formation by non-stack interleaf control according to the embodiment.
FIG. 3D is a diagram for explaining duplex image formation by performing BBAA control for two recording media according to the embodiment.

Given below is the description of duplex image formation by non-stack interleaf control used to remove the dew from a conveying path in an image forming apparatus. FIG. 3A is a diagram for explaining duplex image formation by conventional non-stack interleaf control (first mode interleaf control). FIGS. 3B to 3D are diagrams for explaining duplex image formation by non-stack interleaf control for more than two sheets according to the embodiment (second mode interleaf control). FIG. 3D is a diagram for explaining duplex image formation by performing BBAA control for two sheets according to the embodiment. The rectangles in each of FIGS. 3A to 3D are arranged in an order of image formation, and represent a first side or a second side of a sheet (e.g., "sheet 1 side 2", "sheet 2 side 2"). The sequence in which each sheet is fed from a sheet feeding cassette is given below the corresponding rectangle (e.g., "fed 1st", "fed 2nd"). Similarly, the sequence in which each sheet is discharged to a catch tray is given above the corresponding rectangle (e.g., "discharged 1st", "discharged 2nd").

The BBAA control for two sheets referred herein indicates that duplex image formation is performed for a set of two sheets. In the BBAA control for two sheets, first, an image is sequentially formed on the second side of each of the two sheets. Subsequently, an image is sequentially formed on the first side of each of the two sheets.

It is clear from FIGS. 3A to 3*d* that an image may not be properly transferred on the first side of a sheet fed at first (i.e., sheet 1 side 1) due to dew condensation in a conveying path. To avoid such a problem, the second mode interleaf control is implemented in which a blank sheet is conveyed via the conveying path and subjected to fixing without transferring a toner image thereon (see FIGS. 3B and 3C). As a result, the dew picked up by the blank sheet evaporates. Although the sequence of feeding and discharging a blank sheet is different in FIGS. 3B and 3C, the interleaf control is switched to the first mode interleaf control from the seventh sheet onward ("sheet 2 side 2" onward in FIGS. 3B and 3C).

Meanwhile, in the image forming apparatus 1, the second mode interleaf control can be selected based on the information of the internal temperature and humidity obtained from a temperature-and-humidity sensor (not shown). The second mode interleaf control can also be selected based on the number of image forming jobs to be performed. Moreover, the image forming apparatus 1 can be configured to enable manual selection of the first mode interleaf control and the second mode first mode Interleaf control, or perform automatic selection based on predetermined criteria. By the way, the rotating speed of the pair of re-conveying rollers 58 can be reduced to make sure that the dew is properly removed by a blank sheet during the second mode interleaf control. That is, by reducing the rotating speed of the pair of re-conveying rollers 58, a slack is formed in the blank sheet such that, while passing through the sheet re-conveying path 51, the blank sheet makes contact with a guiding plate of the sheet re-conveying path 51 and picks up the dew gathered on the guiding plate.

Moreover, when a blank sheet is conveyed through the fixing unit 22, the temperature therein or the speed at which a blank sheet passes therethrough can be controlled to facilitate evaporation of the dew. Furthermore, to improve the image quality, the percentage of sheet moisture content can be set to a low percentage lower than that of subsequently fed sheets and the transfer bias voltage can be simultaneously varied.

The interleaf control for duplex image formation with reference to FIGS. 3A to 3D is described for more than two sheets fed from the sheet feeding cassette 2. In that case, a blank sheet is subjected to fixing twice by taking into consideration misfeeding of the sheets in incorrect sequence. Compared with that, the BBAA control for two sheets with reference to FIG. 3D is described for two sheets fed from the sheet feeding cassette 2. In that case, a blank sheet to be subjected to fixing is fed at first from the sheet feeding cassette 2. As a result, it becomes unnecessary to subject another blank sheet to fixing and duplex image formation for subsequent sheets can be performed after completing the BBAA control for two sheets. Thus, it is possible to perform duplex image formation for a plurality of sheets by subjecting only a single blank sheet to fixing.

Figure 4:
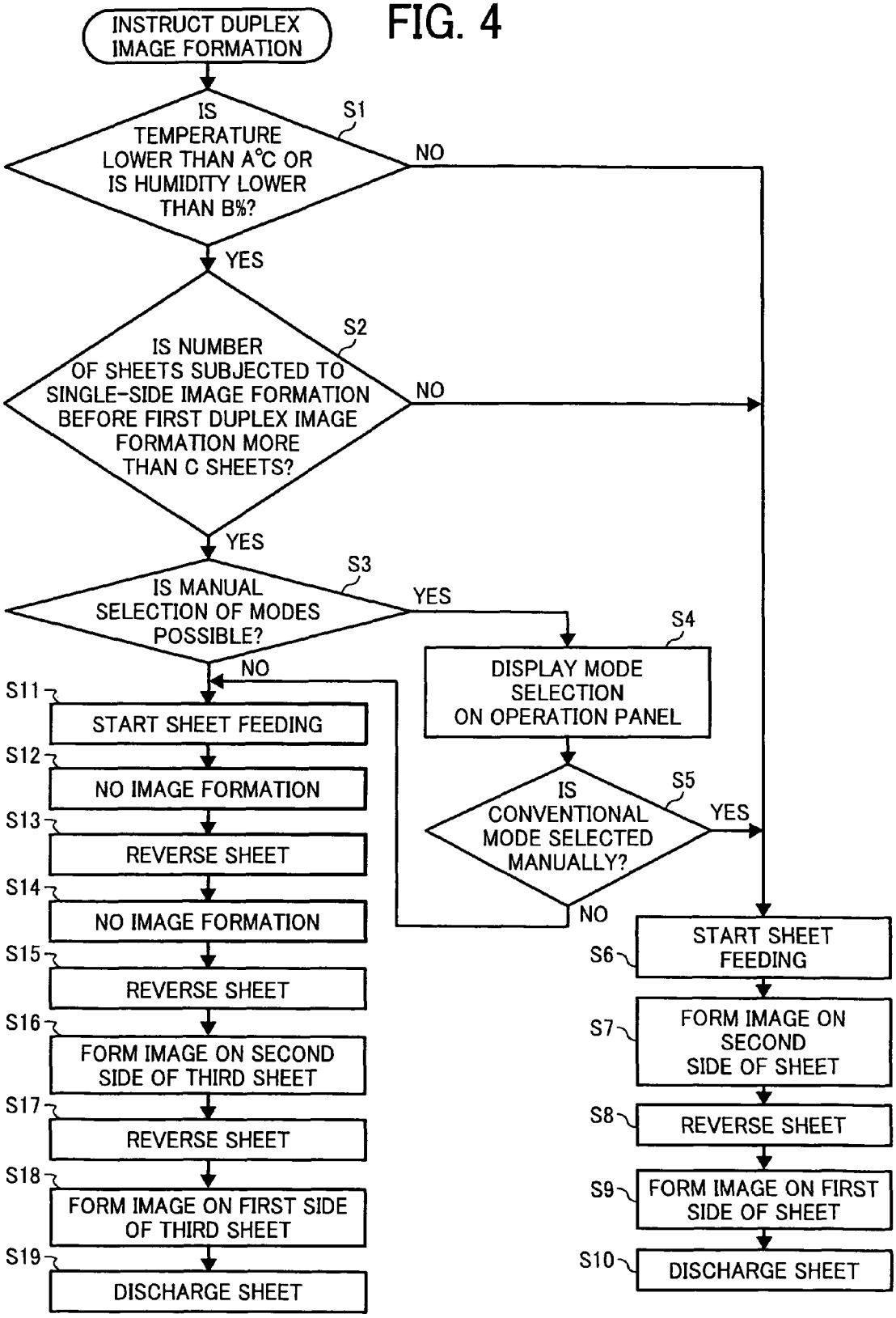
FIG. 4 is a flowchart for explaining a process of interleaf control according to the embodiment.

FIG. 4 is a flowchart for explaining a process of selecting the first mode interleaf control or the second mode interleaf control. First, the temperature-and-humidity sensor determines whether the internal temperature and humidity is less than a predetermined temperature and humidity, respectively (Step S1). If the internal temperature and humidity is not less than a predetermined temperature and humidity (No at Step S1), the first mode interleaf control is performed (Steps S6 to S10). If the internal temperature and humidity is less than a predetermined temperature and humidity (Yes at Step S1), then it is determined whether the number of sheets subjected to single-side image formation before subjecting a sheet to duplex image formation exceeds a predetermined number (Step S2). If the number of sheets subjected to single-side image formation does not exceed the predetermined number (No at Step S2), the first mode interleaf control is performed (Steps S6 to S10). If the number of sheets subjected to single-side image formation exceeds the predetermined number (Yes at Step S2), it is determined whether the image forming apparatus 1 is configured to enable a user to manually select the first mode interleaf control or the second mode interleaf control (Step S3). If the image forming apparatus 1 is configured to enable user selection (Yes at Step S3), a mode selection option is displayed on an operation panel of the image forming apparatus 1 (Step S4). The first mode Interleaf control is performed (Steps S6 to S10) if selected by the user (Yes at Step S5). The second mode interleaf control is performed (Steps S11 to S19) if selected by the user (No at Step S5). Meanwhile, if the image forming apparatus 1 is not configured to enable user selection (No at Step S3)., the image forming apparatus 1 automatically performs the second mode interleaf control (Steps S11 to S19). A control unit can be arranged in the image forming apparatus 1 to control the automatic selection of the second mode interleaf control.

Thus, according to an aspect of the present invention, a duplex image formation mechanism by interleaf control can be implemented to efficiently remove dew condensation in a sheet conveying path in an image forming apparatus. Thus, the image quality can be maintained without increasing the manufacturing cost or affecting the user-friendliness of the image forming apparatus.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus that transfers a toner image on a recording medium in a transfer unit and fixes the toner image on the recording medium in a fixing unit, and that is capable of performing duplex image formation, the image forming apparatus comprising a control unit that performs a first control in which a toner image is transferred and fixed on a second side of a recording medium after a toner image is transferred and fixed on a first side thereof, and a second control in which, after a toner image is transferred and fixed on a first side of a recording medium fed at first, a second side of the recording medium is subjected to fixing without transferring thereon a toner image.

2. The image forming apparatus according to claim 1, wherein a discharging path for discharging a recording medium and a re-conveying path for duplex image formation bifurcate at a bifurcation point at a position above the fixing unit.

3. The image forming apparatus according to claim 1, further comprising a sensor that measures a parameter indicative of any one of an internal temperature and an internal humidity of the image forming apparatus, and outputs measured parameter, wherein the control unit compares the measured parameter with a predetermined parameter, obtains a comparing result, and performs either one of the first control and the second control based on the comparing result.

4. The image forming apparatus according to claim 1, wherein the control unit performs the second control when a number of recording media subjected to single-side image formation before subjecting a recording medium to duplex image formation exceeds a predetermined number.

5. The image forming apparatus according to claim 1, further comprising a switch with which a user can manually select either one of the first control and the second control.

6. The image forming apparatus according to claim 1, wherein the control unit automatically performs selection of either one of the first control and the second control.

7. An image forming apparatus that transfers a toner image on a recording medium in a transfer unit and fixes the toner image on the recording medium in a fixing unit, and that is capable of performing duplex image formation by an interleaf control of more than two recording media, the image forming apparatus comprising a control unit that performs a first control in which a toner image is transferred and fixed on a second side of a recording medium after a toner image is transferred and fixed on a first side thereof, and a second control in which, after a toner image is transferred and fixed on a first side of a recording medium fed at first, a second side of the recording medium is subjected to fixing without transferring thereon a toner image, and usual interleaf control is performed thereafter.

8. The image forming apparatus according to claim 7, wherein a discharging path for discharging a recording medium and a re-conveying path for duplex image formation bifurcate at a bifurcation point at a position above the fixing unit.

9. The image forming apparatus according to claim 7, further comprising a sensor that measures a parameter indicative of any one of an internal temperature and an internal humidity of the image forming apparatus, and outputs measured parameter, wherein the control unit compares the measured parameter with a predetermined parameter, obtains a comparing result, and performs either one of the first control and the second control based on the comparing result.

10. The image forming apparatus according to claim 7, wherein the control unit performs the second control when a number of recording media subjected to single-side image formation before subjecting a recording medium to duplex image formation exceeds a predetermined number.

11. The image forming apparatus according to claim 7, further comprising a switch with which a user can manually select either one of the first control and the second control.

12. The image forming apparatus according to claim 7, wherein the control unit automatically performs selection of either one of the first control and the second control.

13. An image forming apparatus that transfers a toner image on a recording medium in a transfer unit and fixes the toner image on the recording medium in a fixing unit, and that is capable of performing duplex image formation by a BBAA control for two recording media, the image forming apparatus comprising a control unit that performs a first control in which a toner image is transferred and fixed on a second side of a recording medium after a toner image is transferred and fixed on a first side thereof, and a second control in which a recording medium fed at first is subjected to fixing without transferring thereon a toner image, and usual BBAA control for two recording media is performed thereafter.

14. The image forming apparatus according to claim 13, wherein a discharging path for discharging a recording medium and a re-conveying path for duplex image formation bifurcate at a bifurcation point at a position above the fixing unit.

15. The image forming apparatus according to claim 13, further comprising a sensor that measures a parameter indicative of any one of an internal temperature and an internal humidity of the image forming apparatus, and outputs measured parameter, wherein the control unit compares the measured parameter with a predetermined parameter, obtains a comparing result, and performs either one of the first control and the second control based on the comparing result.

16. The image forming apparatus according to claim 13, wherein the control unit performs the second control when a number of recording media subjected to single-side image formation before subjecting a recording medium to duplex image formation exceeds a predetermined number.

17. The image forming apparatus according to claim 13, further comprising a switch with which a user can manually select either one of the first control and the second control.

18. The image forming apparatus according to claim 13, wherein the control unit automatically performs selection of either one of the first control and the second control.

* * * * *